US005858914A

United States Patent [19]

Shibahashi et al.

[11] Patent Number: 5,858,914

[45] Date of Patent: Jan. 12, 1999

[54] THERMOCHROMIC COLORING COLOR-MEMORY FOOTWEAR

[75] Inventors: Yutaka Shibahashi; Katsuyuki Fujita; Akio Nakashima, all of Aichi, Japan

[73] Assignee: The Pilot Ink Co., Ltd., Aichi, Japan

[21] Appl. No.: 668,818

[22] Filed: Jun. 24, 1996

[30] Foreign Application Priority Data

Jun. 23, 1995 [JP] Japan ..... 7-181041

[51] Int. Cl.[6] ..... B41M 5/34

[52] U.S. Cl. ..... 503/201; 36/98; 36/100; 503/204; 503/206; 503/208; 503/215; 503/216; 503/217; 503/226

[58] Field of Search ..... 428/195, 913, 428/914; 503/201, 215–217, 226, 206, 208, 209, 204; 36/98, 100

[56] References Cited

U.S. PATENT DOCUMENTS

| | | | |
|---|---|---|---|
| 4,720,301 | 1/1988 | Kito et al. | 106/21 |
| 4,920,991 | 5/1990 | Shibahashi et al. | 132/73 |
| 5,079,049 | 1/1992 | Kito et al. | 428/24 |
| 5,085,607 | 2/1992 | Shibahashi et al. | 446/14 |
| 5,352,649 | 10/1994 | Shibahashi et al. | 503/207 |
| 5,375,271 | 12/1994 | Frankel | 4/581 |
| 5,376,772 | 12/1994 | Nakagawa et al. | 219/227 |

FOREIGN PATENT DOCUMENTS

| | | | |
|---|---|---|---|
| 57-131105 | 8/1982 | Japan | 503/201 |
| 58-12302 | 10/1984 | Japan | 503/201 |

*Primary Examiner*—Bruce H. Hess
*Attorney, Agent, or Firm*—Sughrue, Mion, Zinn, Macpeak & Seas, PLLC

[57] ABSTRACT

A footwear has a thermochromic coloring color-memory layer having a large hysteresis on a color-density-to-temperature curve so as to show interchangeability between a first color phase and a second color phase different from the first color phase, and a coloring tool for forming a desired image on the footwear.

6 Claims, 2 Drawing Sheets

THERMOCHROMIC COLORING COLOR-MEMORY FOOTWEAR

BACKGROUND OF THE INVENTION

1. Field of the Invention

The present invention relates to a thermochromic coloring color-memory footwear and a footwear having a coloring tool for forming a desired image thereon. Particularly, the present invention relates to footwear which changes the phase of the footwear surface interchangeably and visibly between two phases depending on temperature changes, and memorizes either one of the phases in a normal temperature range visibly, and a cooling or heating coloring tool for forming a desired image or making the desired image disappear on the surface of the footwear.

2. Description of the Related Art

Conventionally, some proposals have been disclosed about footwear such as shoes or the like colored with reversible thermochromic coloring material (Japanese Utility Model Unexamined Publication No. Sho-57-131105, and Japanese Utility Model Unexamined Publication No. Sho-58-12302).

In the above-mentioned conventional thermochromic coloring footwear, its color changes before and after a color-change point as a boundary so that only a specific one of the phases before and after the change can exit at room temperature. That is, when the thermochromic coloring footwear is in the other phase, the thermochromic coloring footwear returns its phase at room temperature if the application of heat or cool required for providing the other phase is eliminated. Accordingly, even if interest or surprise in color change is given indeed, it is not possible to memorize a desiredly selected one of the two phases before and after the change in a room temperature range.

SUMMARY OF THE INVENTION

It is an object of the present invention to provide a footwear having two-sidedness in which the footwear changes its color between two color phases depending on temperature changes, and in which even after heat or cool is removed, desiredly selected one of the two phases before and after the change can be memorized visibly in a room temperature range, and to provide a footwear having a color changing tool for making a desired thermochromic coloring image appear and disappear on the footwear so as to make the footwear to show various appearance patterns.

In a thermochromic coloring color-memory footwear according to the present invention, a thermochromic coloring color-memory layer is disposed on a surface of a footwear, the layer including a quasi-reversible thermochromic coloring material showing interchangeability between a first color phase and a second color phase and having a two-phase holding temperature range in normal temperature where both the first and second color phase coexist. In a process where the temperature of the thermochromic coloring material is rising when the quasi-reversible coloring material is in the first color phase, the quasi-reversible thermochromic coloring material starts to change its color from the first color phase when the temperature reaches a third temperature and turns into the second color phase completely in a temperature range not lower than a fourth temperature which is higher than the third temperature. In a process where the temperature is coming down when the quasi-reversible coloring material is in the second color phase, the quasi-reversible coloring material starts to change its color from the second color phase when the temperature reaches a second temperature which is lower than the third temperature and turns into the first color phase completely in a temperature range not higher than a first temperature which is lower than the second temperature, the quasi-reversible coloring material showing a hysteresis characteristic that both the first color phase and the second color phase can coexist in a temperature range between the second temperature and the third temperature. The first temperature is in the range of −20° C. to 15° C., the fourth temperature is in the range of 27° C. to 70° C., and a temperature range between the second temperature and the third temperature is a temperature range between 10° C. and 35° C.

The thermochromic coloring color-memory layer formed on the surface of the footwear has a large hysteresis characteristic as shown in FIG. 3 with respect to the color-density-to-temperature curve so as to show interchangeability between the first color phase and the second color phase. Accordingly, a phase changed in the temperature range (room temperature range) of from 10° to 35° C. can be memorized alternatively and visibly after the heat or cool required for the color change is removed. Then, a cool- or heat-coloring tool has an effective function to make a desired image appear or disappear desiredly.

DETAILED DESCRIPTION OF THE INVENTION

Detailed description of the present invention will be described with reference to the accompanying drawings.

Figure 1:
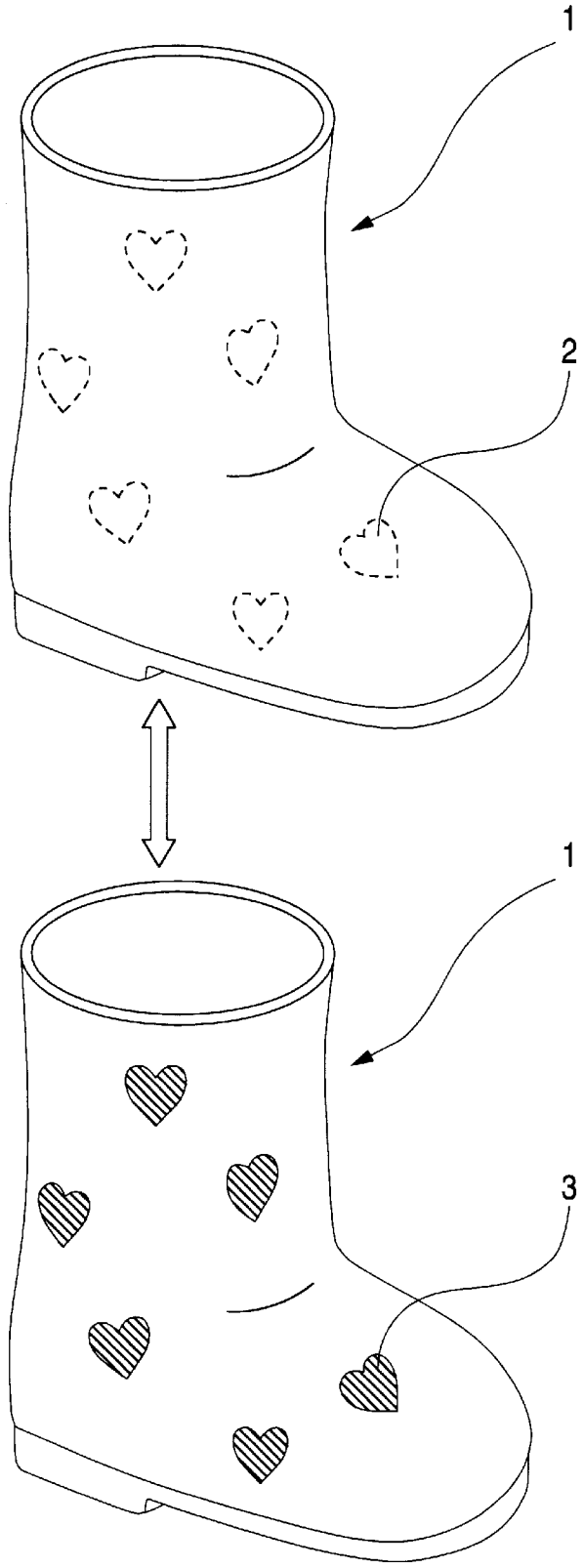
FIG. 1 is an appearance perspective view illustrating phases before and after color change in a thermochromic coloring color-memory footwear according to the present invention.

As shown in FIG. 1, in a thermochromic coloring color-memory footwear 1 according to the present invention, a thermochromic coloring color-memory layer 2 is disposed on a surface of a footwear such as shoes, sandals, slippers or the like.

Figure 2:
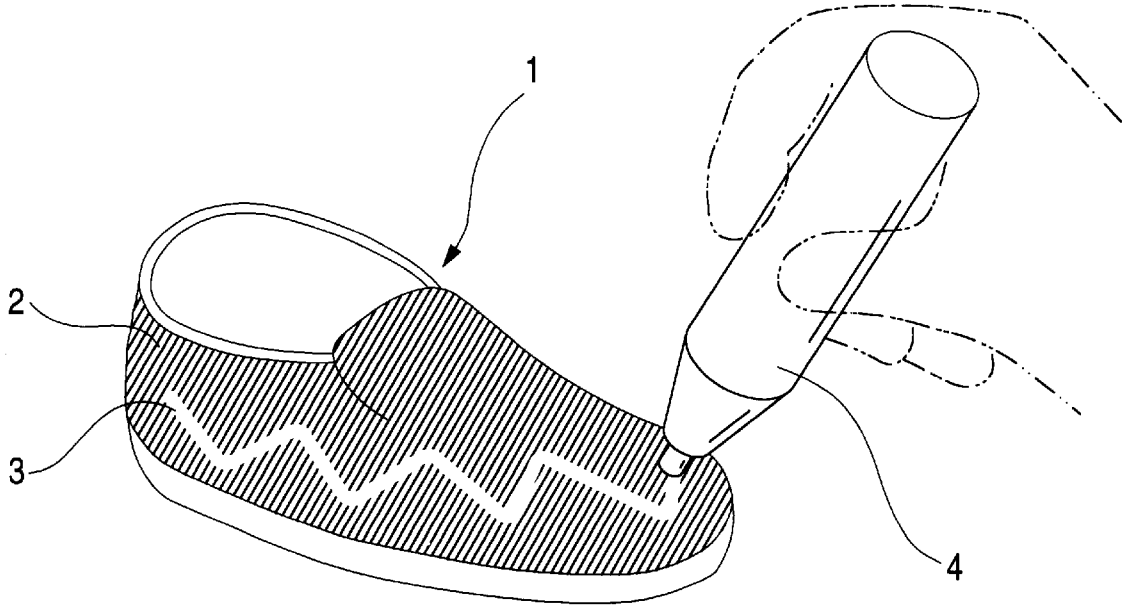
FIG. 2 is an explanatory diagram in the state where an image is formed on the surface of a thermochromic coloring color-memory footwear with a coloring tool according to the present invention.
Figure 3:
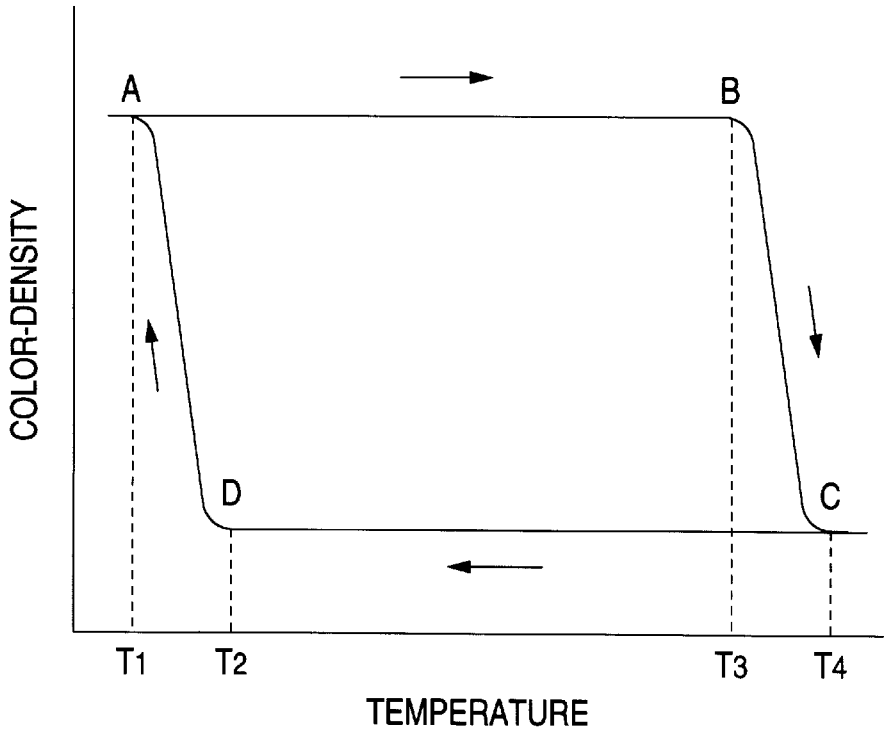
FIG. 3 is a graph illustrating the hysteresis of a thermochromic coloring color-memory layer which is used in the present invention.

The layer 2 is formed in a manner so that microcapsule pigments of particle size of 0.5 to 50 $\mu$m are fixed in a dispersed state in a binder. The microcapsule pigments used in the present invention includes a quasi-reversible thermochromic coloring material having a large hysteresis with respect to a color-density-to-temperature curve so as to show interchangeability between a first color phase and a second color phase different from the first color phase, and the material having a two-phase holding temperature range in normal temperature where both the first and second color can coexist. In this case, one of the first and second color phases may be colorless. The quasi-reversible thermochromic coloring material has a feature showing a change of color density depending on a temperature change as shown in FIG. 3. In a process where the temperature of the thermochromic coloring material is rising when the quasi-reversible coloring material is in a first color phase, the quasi-reversible thermochromic coloring material starts to change its color from the first color phase, and when the temperature reaches a temperature $T_3$, it turns into a second color phase completely in a temperature range not lower than a temperature $T_4$ which is higher than the temperature $T_3$. In a process where the temperature is coming down when the quasi-reversible coloring material is in the second color phase, the quasi-reversible coloring material starts to change its color from the second color phase when the temperature reaches a temperature $T_2$ which is lower than the temperature $T_3$, and it turns into the first color phase completely in a temperature range not higher than a temperature $T_1$ which is lower than the temperature $T_2$. Accordingly, the quasi-reversible coloring material shows such a hysteresis characteristic that both the first color phase and the second color phase can coexist in a temperature range between the temperature $T_2$ and the temperature $T_3$. In the present invention, the temperature $T_1$ is a temperature between −20° C. and 15° C., the temperature $T_4$ is a temperature between 27° C. to 70° C., and the temperature range between the second temperature $T_2$ and the third temperature $T_3$ is a temperature range between 10° C. and 35° C. Further, in the present invention, a non-thermochromic coloring image may be disposed in a layer under the thermochromic coloring color-memory layer, the non-thermochromic coloring image being able to appear and disappear depending on changes in temperature. The thermochromic coloring color-memory layer 2 may be a printed image of a desired image. The thermochromic coloring color-memory layer 2 may be disposed on a part of a base material constituting the footwear surface. A coated layer containing photo-shielding pigments and a photo-stabilizer is formed as an upper layer of the thermochromic coloring color-memory layer 2. Further, the present invention provides a combination of the footwear 1 and a coloring tool 4 as shown in FIG. 2, in which the footwear 1 such as shoes, sandals, slippers or the like has a thermochromic coloring color-memory layer 2 thereon and a coloring tool 4 forms a desired image on a surface of the thermochromic coloring color-memory layer 2 to make the desired image disappear, the thermochromic coloring color-memory layer being formed in a manner so that microcapsule pigments of particle size of 0.5 to 50 μm are fixed in a dispersed state in a binder, the pigments including a quasi-reversible thermochromic coloring material having a large hysteresis with respect to a color-density-to-temperature curve so as to show interchangeability between a first color phase and a second color phase, and having a two-phase holding temperature range in normal temperature where both the first color phase and the second color phase or the color phase can coexist. Also in this case, the first and second color phases are different from each other, and one of them may be colorless.

A composition proposed in U.S. Pat. No. 4,720,301 can be used as the above-mentioned quasi-reversible thermochromic coloring material. Such a composition may comprise (A) an electron-donating chromatic organic compound, (B) a compound selected from the group consisting of phenolic compounds, metal salts of phenolic compounds, aromatic carboxylic acids, aliphatic carboxylic acids having from 2 to 5 carbon atoms, metal salts of carboxylic acids, acidic phosphoric esters, metal salts of acidic phosphoric esters, 1,2,3-triazole compounds, and (C) one or more of the ester compounds having delta T value (melting point—clouding point=delta T) in the range from not lower than 5° C. to not higher than 50° C.

In FIG. 3, the point A (temperature $T_1$) is a point where a phase is shown in which the first color phase appears completely in a range of temperature not higher than this point, the point B (temperature $T_3$) is a point where substantial color-changing from the first color phase to the second color phase starts in a process in which the temperature is rising, the point C (temperature $T_4$) is a point where the second color phase appears completely in a temperature range not lower than this point. The color-changing temperature range is a temperature range between the temperatures $T_1$ and $T_4$, and particularly the temperature range between the temperatures $T_2$ and $T_3$ where both the first color phase and the second color phase can coexist and a difference in color density is large, is referred to as a substantially color-changing temperature range (two-phase holding temperature range).

In the above-mentioned, the temperature $T_1$ is a temperature which can be obtained by water, ice, a freezer, a cold district, etc., that is, which is about from −20° C. to 15° C., and $T_4$ is a temperature which can be obtained by a familiar thing such as body temperature, hot water in a bath, a heater, a hair dryer, etc., that is, which is about from 27° C. to 70° C.

It is preferable to use a quasi-reversible thermochromic coloring material having a substantially color-changing temperature range of from 5° C. to over 35° C., preferably within a range of 10° C. to 35° C.

The quasi-reversible thermochromic coloring material is enclosed in microcapsules so as to be used, in practice, as microcapsule pigments. The microcapsule pigments form the thermochromic coloring color-memory layer 2 on the surface of a support by a well-known conventional printing technique such as screen printing, gravure printing or the like, as printing ink or paint in which the microcapsule pigments are dispersed in a conventional general-purpose binder such as a vehicle including various kinds of synthetic resin emulsion, water-soluble or oil-soluble synthetic resin, ultraviolet setting resin, other thickeners, or the like. Here, the microcapsule pigments occupy 1 to 40 weight % in the layer 2. Being less than 1 weight %, it is difficult to visibly recognize the chromophoric density. On the other hand, being over 40 weight %, incidental color is left undesirably at the time of disappearance of color. When the thickness of the layer 2 is within a range of from 3 μm to 400 μm, preferably within a range of from 5 μm to 200 μm, the balance between coloring and discoloring is proper so as to make the predetermined coloring image 3 appear and disappear effectively.

The above-mentioned photo-shielding pigments are selected from titanium oxide, transparent ferric oxide, transparent ceric oxide, transparent zinc oxide, and the like, and the photo-stabilizer may include an ultraviolet absorber, an anti-oxidizing agent, infrared absorber, and the like, effective to improve the light-fastness.

In the above-mentioned, as the system of titanium oxide, metalescent pigments obtained by coating the surface of natural mica with titanium oxide of 16 to 58 weight % so that the optical thickness of the coated layer is 110 to 415 nm, and the particle size is 5 to 100 μm, are effective, and layers obtained by dispersing and fixing such pigments in a suitable binder may be stacked on the thermochromic coloring color-memory layer 2.

For the above-mentioned attempt to give a metalescent color change by using metalescent pigments, the technique disclosed in U.S. Pat. No. 5,352,649 can be applied.

Further, specifically, it is possible to select, by way of example, from the following pigments. Gold metalescent pigments obtained by coating the surface of natural mica with titanium oxide of 41 to 44 weight % so that the optical thickness of the coated layer is 180 to 240 nm, and having particle size of 5 to 60 μm. Gold metalescent pigments obtained by coating the surface of natural mica with titanium oxide of 30 to 48 weight %, and further applying ferric oxide of 4 to 10 weight % thereon so that the optical thickness of the coated layer is 140 to 240 nm, and having particle size of 5 to 60 μm. Gold metalescent pigments obtained by coating the surface of natural mica with titanium oxide of 30 to 48 weight %, and further applying non-thermochromic color pigments of 0.5 to 10 weight % thereon so that the optical thickness of the coated layer is 140 to 240 nm, and having particle size of 5 to 60 μm. Silver metalescent pigments obtained by coating the surface of natural mica with titanium oxide of 16 to 39 weight % so that the optical thickness of the coated layer is 110 to 170 nm, and having particle size of 5 to 100 μm. Metallic-color metalescent pigments obtained by coating the surface of natural mica with titanium oxide of 45 to 58 weight % so that the optical thickness of the coated layer is 245 to 415 nm, and having particle size of 5 to 60 μm. Metallic-color metalescent pigments obtained by coating the surface of natural mica with titanium oxide of 45 to 58 weight %, and further applying non-thermochromic color pigments of 0.5 to 10 weight % thereon so that the optical thickness of the coated layer is 245 to 415 nm, and having particle size of 5 to 60 μm.

In the above metalescent pigment layer, not only color changes from gold, silver or other various metallic colors by the correlation between the iris effect due to selective interference of visible light rays, the transmission effect, and the brightness of the thermochromic coloring color-memory layer 2, but also the light-fastness is conspicuously improved since ultraviolet rays or visible light rays giving bad influence on the function of the color-memory layer are absorbed or reflected at least partially.

A protective layer can be desirably provided by overcoating on the thermochromic coloring color-memory layer 2. In addition, an ultraviolet absorber, or the like, may be mixed into the layer 2 or the protective layer so as to give light-fastness thereto.

In the system where the base material is a thermoplastic plastic, the above-mentioned microcapsule pigments may be mixed into the plastic, melted and blended, and integrally formed into a sheet-like material as the layer 2.

As the cool- or heat-coloring tool 4, examples may include those which have top end portions of various writing shapes, and those which have top end portions of stamping shapes of images such as characters, figures, patterns, etc. It is possible to use a current-conducting heat-coloring tool having a heating resistor (Japanese Utility Model Unexamined Publication No. Sho-62-139573, or Japanese Utility Model Unexamined Publication No. Hei-4-50100), a heating pen in which hot water or the like is charged into a suitable vessel (Japanese Utility Model Unexamined Publication No. Hei-2-106299 or the like), a coloring tool using a Peltier element (Japanese Patent Unexamined-Publication No. Hei-5-318915), a cooling writing-tool/vessel in which cooling medium such as cold water, ice or the like is charged, and the like. In addition, it is possible to use that which has a structure in which a capillary gap in the axial direction, a plastic body having continuous pores, a fibrous pen body, or the like, is held by a holder or the like, and hot or cold water reserved in a reservoir portion in the axial body is led out from the writing top end so as to write, or it is possible to use that which has a structure in which hot or cold water is directly permeated into a writing top end member or the like so as to write as it is. In addition, it is possible to use that which holds ice pieces, or the like, for cooling directly. In addition, it is possible to use various apparatus for generating hot air or cool air.

A reversible thermochromic coloring layer for indicating temperature may be provided in the axial body, the writing top end portion, or the accessories of the cool- or heat-coloring tool, so that it can be seen easily for the convenience in use whether the cooling or heating means is set within a proper temperature range.

EXAMPLE 1

As shown in FIG. 1, a thermochromic coloring color-memory boot 1 was obtained in a manner so that heart patterns 2 were formed by printing at suitable intervals on the white boot surface with a paint in which microcapsule pigments capable of changing it color between red and colorless (the temperature was 10° C. at the point A, and 32° C. at the point C) were dispersed.

Red heart images 3 were appeared when the boot 1 was cooled to a temperature not higher than 10° C., and were memorized at room temperature near 25° C. Then, the color of the boot 1 disappeared when the boot 1 was heated up to a temperature not lower than 32° C. so that the boot 1 returned to white throughout. Thus, the aspect was memorized at room temperature (25° C.).

EXAMPLE 2

As shown in FIG. 2, a thermochromic coloring color-memory sports shoe 1 having a thermochromic coloring color-memory layer 2 was obtained in a manner so that the sports shoe surface of white textile was sprayed with paint in which microcapsule pigments capable of changing it color between blue and colorless (the temperature was 13° C. at the point A, and 33° C. at the point C) were dispersed. Separately, a heating coloring tool 4 was prepared. The toll 4 contained hot water of 50° C. stored in a plastic axial body and had a metal pen 4 provided with a bullet-like writing top attached and attached to the top end of the tool 4.

When the surface of the sports shoe 1 colored in blue was written with the heating coloring tool 4, the color in the written portion disappeared so that a white image 3 appeared. The white image 3 was memorized at 25° C. outdoors. When the sports shoe 1 was cooled to a temperature not higher than 13° C., it changed into the original blue sports shoe 1 wholly again.

After the whole surface of the sports shoe was heated to a temperature not lower than 33° C. so as to show an aspect of the white sports shoe, a figure or the like was drawn with a brush containing cold water, water with ice pieces, or the like, or a stamping face where a flower pattern was formed was cooled and applied, so that a drawn blue image or a stamp image was made to appear.

EXAMPLE 3

A color-memory sports shoe 1 was obtained in a manner so that the sports shoe surface of white textile was sprayed with spray ink in which a quasi-reversible thermochromic coloring material between blue and colorless (13° C. at the point A, and 40° C. at the point C) and between pink and colorless (20° C. at the point A, and 34° C. at the point C) and yellow non-thermochromic coloring pigments were mixed.

The lower half portion was painted out with a cooling pen, and changed into brown. This phase was held at room temperature (15° to 27° C.). Next, if heated by hand, the lower half portion changed into green, and this state was held at 23° to 33° C. Next, if a character was written with a heating pen in the lower half portion, a yellow image was visually recognized. Next, the upper half portion was painted out with the cooling pen so that the portion turned to the brown phase, and this phase was held at room temperature (15° to 27° C.). When the shoe was put into hot water of 45° C., it recovered the yellow shoe. When the shoe as a whole was cooled by ice or water or in a cool place to make the whole shoe brown, and such a operation was repeated, similar color changes were produced and repeated, and the phase could be changed.

EXAMPLE 4

After a paint obtained by dispersing 15 weight % of microcapsule pigments changeable between black and colorless (10° C. at the point A, and 40° C. at the point C) and 3 weight parts of fluorescent orange pigments in an oil vehicle containing a binder was sprayed onto the surface of a white shoe, the shoe was coated with a paint obtained by dispersing, in an oil vehicle containing a binder, 3 weight parts of metalescent pigments obtained by coating the surface of natural mica with titanium oxide of 57 weight % so that the optical thickness of the coated layer is 395 nm, and having particle size of 10 to 60 μm. The shoe showed metallic green color at a temperature not higher than 10° C., but the metallic green color disappeared at a temperature not lower than 40° C. so that the shoe turned fluorescent orange color, and the fluorescent orange color was kept at 25° C. outdoors.

As described above, the metallic green color and the fluorescent orange color could be selected desirably, and a desired design could be formed when a proper place was partially heated to a temperature not lower than 40° C., or partially cooled to a temperature not higher than 10° C.

In a system where a proper non-thermochromic coloring image (with general-purpose printing ink) is disposed in advance in a lower layer of the thermochromic coloring color-memory layer 2 so that the layer disappears at the time of coloring, a non-thermochromic coloring image can be made to appear when the color of the thermochromic coloring color-memory layer disappears.

It is possible to obtain and practically use a footwear in which a changed phase can be memorized in a room temperature range even after heat or cool required for phase change is removed so that various phases are shown. Particularly, with a heat- or cool-coloring tool applied thereto, it is possible to provide a footwear such as shoes, sandals, slippers, or the like, having an appearance so as to satisfy a users creativity, where the user can enjoy forming various images such as desired hand-written images or stamp images easily, these images can be made to disappear desirably, and other desired images can be formed.

What is claimed is:

1. A thermochromic coloring color-memory footwear, in which a thermochromic coloring color-memory layer having a thickness in the range of 3 to 400 μm is disposed on a surface of said footwear, said thermochromic coloring color-memory layer including a quasi-reversible thermochromic coloring material showing interchangeability between a first color phase and a second color phase and having a two-phase holding temperature range in normal temperature where both said first and second color phase coexist;

wherein said thermochromic coloring color-memory layer is formed by fixing microcapsule pigments having a particle size of 0.5 to 50 μm in a binder in dispersed state, the microcapsule enclosing said quasi-reversible thermochromic coloring material, the amount of said microcapsule pigments being in the range of 1 to 40 wt % based on the total amount of said thermochromic coloring color-memory layer;

wherein a coated layer containing photo-shielding pigments and/or a photo-stabilizer is formed as an upper layer of said thermochromic coloring color-memory layer;

wherein when the temperature of said thermochromic coloring material is rising and the quasi-reversible thermochromic coloring material is in said first color phase, said quasi-reversible thermochromic coloring material starts to change its color from said first color phase when the temperature reaches a third temperature and turns into said second color phase completely in a temperature range not lower than a fourth temperature which is higher than said third temperature; and when the temperature is coming down and the quasi-reversible thermochromic coloring material is in said second color phase, the quasi-reversible thermochromic coloring material starts to change its color from said second color phase when the temperature reaches a second temperature which is lower than said third temperature and turns into said first color phase completely in a temperature not higher than a first temperature which is lower than said second temperature, said quasi-reversible thermochromic coloring material showing a hysteresis characteristic such that both said first color phase and said second color phase can coexist in a temperature range between said second temperature and said third temperature; wherein said first temperature is in the range of −20° C. to 15° C., said fourth temperature is in the range of 27° C. to 70° C., and a temperature range between said second temperature and said third temperature is a temperature range between 10° C. and 35° C.; and wherein said quasi-reversible thermochromic coloring material comprises (A) an electron-donating chromatic organic compound, (B) a compound selected from the group consisting of phenolic compounds, metal salts of phenolic compounds, aromatic carboxylic acids, aliphatic carboxylic acids having from 2 to 5 carbon atoms, metal salts of carboxylic acids, acidic phosphoric esters, metal salts of acidic phosphoric esters, and 1,2,3-triazole compounds, and (C) one or more of ester compounds having delta T value (melting point—clouding point=delta T) in the range from not lower than 5° C. to not higher than 50° C.

2. A thermochromic coloring color-memory footwear according to claim 1, wherein a non-thermochromic coloring image is disposed in a layer under said thermochromic coloring color-memory layer, said non-thermochromic coloring image appearing and disappearing depending on changes in temperature.

3. A thermochromic coloring color-memory footwear according to claim 1, wherein said thermochromic coloring color-memory layer is a printed image of a desired image or a pattern-drawn image of a desired image.

4. A thermochromic coloring color-memory footwear according to claim 1, wherein said thermochromic coloring color-memory layer is disposed on a part of a base material constituting the footwear surface.

5. A thermochromic coloring color-memory footwear according to claim 1, including a cooling or heating coloring tool for forming a desired image on a surface of said thermochromic said thermochromic coloring color-memory layer and making said desired image disappear.

6. A thermochromic coloring color-memory footwear according to claim 1, wherein a coated layer containing photo-shielding pigments and a photo-stabilizer is formed as an upper layer of said thermochromic coloring color-memory layer.

* * * * *